United States Patent [19]

Nakamura et al.

[11] 4,152,157

[45] May 1, 1979

[54] COLOR IMAGE FORMING PROCESS

[75] Inventors: Shigeru Nakamura; Isao Shimamura; Masatoshi Sugiyama, all of Minami-ashigara, Japan

[73] Assignee: Fuji Photo Film Co., Ltd., Kanagawa, Japan

[21] Appl. No.: 902,138

[22] Filed: May 2, 1978

[30] Foreign Application Priority Data

May 2, 1977 [JP] Japan ..... 52-50910

[51] Int. Cl.[2] ..... G03C 7/00

[52] U.S. Cl. ..... 96/53; 96/20; 96/119 PQ

[58] Field of Search ..... 96/53, 20, 60 R, 119 PQ, 96/99

[56] References Cited

U.S. PATENT DOCUMENTS

| | | | |
|---|---|---|---|
| 2,270,118 | 1/1942 | Gaspar | 96/53 |
| 3,340,060 | 9/1967 | Meyer et al. | 96/53 |
| 3,503,741 | 3/1970 | Wilson et al. | 96/99 |

*Primary Examiner*—J. Travis Brown

*Attorney, Agent, or Firm*—Sughrue, Rothwell, Mion, Zinn and Macpeak

[57] ABSTRACT

A color image forming process which comprises processing a photographic light-sensitive element comprising a support having thereon a layer containing silver imagewise distributed therein with an aqueous alkaline solution containing a boron hydride compound in the presence of a dye to bleach the dye in an imagewise manner. By the process of this invention, color images which are stable to light, heat and moisture are formed using light-sensitive elements containing a reduced amount of silver salt and without using chemicals causing environmental pollution problems for the processing.

18 Claims, No Drawings

COLOR IMAGE FORMING PROCESS

BACKGROUND OF THE INVENTION

1. Field of the Invention

This invention relates to a color image forming process. More particularly, the invention relates to a color image forming process which comprises processing a photographic element comprising a support having thereon a layer containing silver imagewise distributed therein with an aqueous alkaline solution containing a boron hydride compound in the presence of a dye to bleach the dye in an imagewise manner.

2. Description of the Prior Art

In a general process of forming color images, azomethine dyes or indoaniline dyes are formed by developing silver halide light-sensitive materials in the presence of couplers using a primary aromatic amine developing agent. Color development using silver halide is based on the process invented by L. D. Mannes and L. Godowsky in 1935. Various improvements have been made in the process since then, and, in general, the system has been employed worldwide in the photographic art.

Color development using a primary aromatic amine developing agent generaly has the following disadvantages. That is, (1) the dyes formed by the system have poor light resistance, heat resistance, and moisture resistance and, hence, the color images formed have a great tendency to fade with the passage of time, (2) a primary aromatic amine developing agent is toxic, for example, causing skin rashes and, thus, specific precautions are required in using this type of developing agent, and (3) since there is an equivalency relationship between the dye image and the oxidation product of the color developing agent, it is theoretically difficult to reduce the amount of the silver halide which takes part in the dye formation to an amount lower than the stoichiometrically required amount.

Conventional techniques of reducing the amount of silver halide in color photography can be classified into reducing the amount of silver halide present over the stoichiometrically required amount thereof to as low as possible and reducing the stoichiometrically required amount of silver halide itself. In regard to the latter approach, the so-called two equivalent couplers capable of forming one molecule of dye with two molecules of silver halide have been developed. However, even using this technique, it is theoretically difficult to reduce the amount of silver salt in the light-sensitive materials to less than ½ of the amount of silver salt in light-sensitive materials containing couplers other than two equivalent couplers.

Another color photographic process other than the above-mentioned processes employed at present is the silver-dye-bleach photographic process. This process is based on the color photographic process invented by Gaspar and, since azo dyes are used in the color process, the color images formed by the process generally have excellent light resistance, heat resistance and moisture resistance.

A typical photographic element used for the silver-dye-bleach color photographic process has three silver halide photographic emulsion layers respectively sensitized to red, green and blue light, and having associated therewith, respectively, a bleachable cyan, magenta and yellow dye. Such a photographic element provides color photographic positive images through the following processing.

(1) The photographic element is imagewise exposed.

(2) The exposed photographic element is developed in a silver halide developer to form negative silver images, the photographic element is then processed in a dye bleach bath which oxidizes the silver images to a silver salt and concurrently decolorizes the associated dye pattern, and, finally the photographic element is fixed and washed to remove the residual silver salt, whereby dye images are obtained which are photographically the reverse of the initial silver images. The silver-dye-bleach process is generally described in, for example, U.S. Pat. Nos. 3,498,787 and 3,503,741, Canadian Pat. No. 790,533 and A. Meyer, "Some Features of the Silver-Dye-Bleach Process", *The Journal of Photographic Science,* Vol. 13, pp. 90–97 (1965).

In the silver-dye-bleach process as described in U.S. Pat. No. 2,270,118, dye images are formed by processing dye-containing layers having silver images therein with an acid solution which decomposes the dyes at the areas where silver is present. The decomposition or destruction of the dye is accelerated by various "catalysts" such as phenazine. Also, the reaction in these dye bleach systems is considered to proceed on a stoichiometric basis (for example, U.S. Pat. No. 3,340,060 in Column 1, lines 18–21 suggests that 4 atoms of silver are required for decomposing one azo dye group).

However, these silver-dye-bleach processes have the following disadvantages:

(1) Since a large amount of silver is required for bleaching the dyes, the photosensitive materials must contain a large amount of silver halide in the silver halide photographic emulsion layers.

(2) Since a strongly acidic processing solution, which is highly corrosive, is usually used in these processes, difficulties are encountered in storing and handling the processing solution.

Recently, numerous investigations have been made for conserving silver as a resource, increasing the efficiency of the reaction system, and improving the quality of the color images formed by reducing the amount of silver required to decompose each molecule of dye.

SUMMARY OF THE INVENTION

An object of this invention, therefore, is to provide a process of forming color images having excellent light resistance, heat resistance and moisture resistance using light-sensitive materials containing a reduced amount of silver salt.

Another object of this invention is to provide a process of forming color images having excellent light resistance, heat resistance and moisture resistance without using chemicals which cause pollution problems.

Still another object of this invention is to provide a process of forming color images which are stable to light, heat and moisture using a less corrosive processing solution.

These objects of this invention are accomplished by processing a photographic element comprising a support having thereon a layer containing silver imagewise distributed therein with an aqueous alkaline solution containing a boron hydride compound in the presence of a dye to bleach the dye in an imagewise manner.

DETAILED DESCRIPTION OF THE INVENTION

According to the process of this invention, silver imagewise distributed in the photographic element acts as a catalyst and hence the amount of silver salt employed in the photographic element can be greatly reduced. That is, in the process of this invention, the bleaching of the dye can be sufficiently performed with an amount of silver of less than about 1/5 of the amount of silver required in the conventional silver-dye-bleach process.

A conventional photographic material contains about 3 to about 10 g/m$^2$ of silver salt as silver and a photographic printing material contains about 1 to about 4 g/m$^2$ of silver but the coated amount of silver in the photographic material used in this invention is less than about 3 g/m$^2$, in particular, less than 2 g/m$^2$. Also, in the case of a multilayer photographic material used in this invention, the coated amount of silver for each silver halide emulsion layer is about 10 mg/m$^2$ to about 1 g/m$^2$, in particular, 10 mg/m$^2$ to 0.5 g/m$^2$.

According to one embodiment of this invention, color images are formed by processing a photographic element comprising a support having thereon a layer containing silver imagewise distributed therein with an aqueous alkaline solution containing a boron hydride compound in the presence of a dye to bleach the dye in an imagewise manner.

In a preferred embodiment of this invention, color positive images are obtained by imagewise exposing a photographic element comprising a support having thereon at least one silver halide emulsion layer containing silver halide and a dye followed by development to form an image pattern of developed silver and then processing the photographic element having the silver image pattern in an aqueous alkaline solution containing a boron hydride compound to bleach the dye so that the dye becomes colorless at the areas containing the silver image pattern.

In another embodiment of this invention, color negative images are obtained using a direct positive silver halide emulsion as the silver halide emulsion in the above-described embodiment of the process of this invention.

In still another embodiment of this invention, color positive images are obtained by imagewise exposing a photographic element comprising a support having thereon at least one silver halide emulsion layer followed by development, then immersing the photographic element in a dye-containing bath to dye the photographic element with the dye in the bath, and then immersing the dyed photographic element in an alkaline aqueous solution containing a boron hydride compound to bleach the dye in an imagewise manner.

In another embodiment of this invention, a print-out silver image formed by imagewise exposing a silver salt light-sensitive material is utilized. In this embodiment, a dye is incorporated into a conventional light-sensitive photographic material comprising a support having thereon a silver halide emulsion layer containing a known halogen-acceptor accelerating the print-out effect or a dye is incorporated into a photographic material comprising a support having thereon a layer containing a silver salt capable of being easily thermally decomposed, such as a silver salt of a fatty acid. In the process of this invention, a print-out silver image is formed by exposing a photographic element containing such a silver salt and a dye and then the imagewise exposed photographic element is immersed in an aqueous alkaline solution containing a boron hydride compound, whereby the dye is bleached at the areas containing the print-out silver image to provide a color positive image.

This invention can also be applied to a photographic element in which a silver image pattern is formed upon heat development, that is, in the process, an element comprising a support and having thereon one or more layers containing a light-sensitive silver salt, a reducing agent, a silver providing agent such as silver behenate and a dye is imagewise exposed and then heated, whereby a silver image is formed. The silver image formed acts as a catalyst when such a photographic element imagewise exposed and heat developed is immersed in an aqueous alkaline solution containing a boron hydride compound to bleach the dye in an imagewise manner.

Although the principle of the process of this invention is not at present clear and while not desiring to be bound, it is believed that silver present in the photographic element acts as a catalyst for decomposing the boron hydride compound and the boron hydride compound is decomposed generating a certain kind of activated moiety which reductively decomposes the dye.

In a conventional silver-dye-bleach process, a catalyst such as phenazine is used to form the reduction product (dihydro compound) of phenazine by reaction of silver and phenazine, the reduction product reductively bleaches the dye, and thus the dye is decomposed through a leuco material. With an azo dye which is usually used, 4 equivalents of silver are required for decomposing each azo group equivalent. On the other hand, surprisingly in the process of this invention, only $\frac{1}{2}$ to $\frac{1}{8}$ equivalent of silver is usually required for decomposing one azo group equivalent of a dye. While on superficial examination, the present invention could be considered to be similar to a conventional silver-dye-bleach process since the dye is reductively decomposed, however, in this invention, silver acts as a catalyst to decompose the boron hydride compound, while silver per se acts as a reducing agent in a conventional silver-dye-bleach process. As a result, a marked difference occurs between the proces of this invention and the above-described conventional silver-dye-bleach process with respect to the quantitative relationship between silver and dye.

In the photographic elements which are employed in this invention, the dye is incorporated into the photographic material in an amount of about 100% excess to about 5,000% excess, preferably 200% excess to 2,000% excess, over the stoichiometrically required amount based on the silver salt employed.

The boron hydride compound which is used in this invention is a reducing compound containing at least one boron atom in the molecule thereof. A boron hydride compound has at least one boron-to-hydrogen bond in the molecule thereof and the hydrogen atom is very reactive and gives rise to the reducing action. Suitable boron hydride compounds which can be used in this invention include those which are known in the photographic art as fogging agents and are used in the processing of reversal color light-sensitive elements or are used as fogging agents for direct positive light-sensitive elements. Specific examples are illustrated in, for example, U.S. Pat. Nos. 2,984,567, 3,246,987, 3,554,748, 3,361,564 and 3,637,392, British Patents 1,008,013, 1,011,000 and 1,202,842.

Preferred boron hydride compounds which can be used in this invention are represented by the following general formulae (I) to (IV):

$$MBH_4 \quad (I)$$

wherein M represents an alkali metal ion (for example, $Li^+$, $Na^+$, $K^+$, etc.);

$$M_1BH_3 \quad (II)$$

wherein $M_1$ represents ammonia, an amine [such as an alkylamine (for example, methylamine, dimethylamine, trimethylamine, ethylamine, diethylamine, ethanolamine, diethanolamine, triethanolamine, tert-butylamine, etc.), a polyamine (for example, ethylenediamine, 2-aminoethylamine, etc.), an aromatic amine (for example, aniline, methylaniline, dimethylaniline, etc.), a heterocyclic amine (for example, pyridine, 2,4-lutidine, etc.)], a hydrazine, or a phosphine (for example, methylphosphine, ethylphosphine, diethylphosphine, triethylphosphine, phenylphosphine, etc.);

(III)

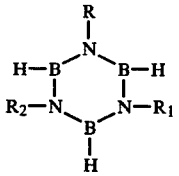

wherein R, $R_1$ and $R_2$, which may be the same or different, each represents a hydrogen atom, a halogen atom (for example, a chlorine atom, etc.), an alkyl group (preferably an alkyl group having 1 to 3 carbon atoms, for example, a methyl group, an ethyl group, etc.), or an alkoxy group (preferably an alkoxy group having 1 to 3 carbon atoms, for example, a methoxy group, an ethoxy group, etc.);

$$(M_2{}^{+c})_x(B_yH_z)^{-xc} \quad (IV)$$

wherein $M_2$ represents an ammonium ion, a quaternary ammonium ion such as a tetraalkyl ammonium ion (a tetraalkyl ammonium ion in which each alkyl group has 1 to 18 carbon atoms, for example, tetramethyl ammonium, tetraethyl ammonium, tetrabutyl ammonium, trimethyl octadecyl ammonium, etc.), a heterocyclic quaternary ammonium ion (for example, thiazolium, oxazolium, imidazolium, indolium, pyridinium, quinolinium, pyrrolinium, pyrrolidinium, etc.), a sulfonium ion (for example, trimethyl sulfonium, triethyl sulfonium, etc.), a quaternary phosphonium ion (for example, tetramethyl phosphonium, tetraethylphosphonium, etc.), an alkali metal ion (for example, sodium ion, potassium ion, lithium ion, etc.), or an alkaline earth metal ion (for example, calcium ion, barium ion, strontium ion, magnesium ion, etc.); c represents a positive integer (preferably 1 to 3); x represents a positive integer (preferably 1 to 2); y represents a positive integer (preferably 2 to 20); and z represents a positive integer not less than 4 (preferably 6 to 14).

Specific examples of boron hydride compounds represented by the general formulae (I) to (IV) which can be used in this invention are shown below:

Compounds of the General Formula (I)

$NaBH_4$ $KBH_4$ $LiBH_4$

Compounds of the General Formula (II)

$(CH_3)_3NBH_3$ $(CH_3)_2NH—BH_3$ $(C_2H_5)_2NH—BH_3$ $t\text{-}C_4H_9NH_2—BH_3$

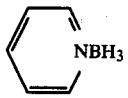

$H_3B—H_2NCH_2CH_2NH_2—BH_3$ $H_3B—NH_2NH_2—BH_3$ $(CH_3)_2PH—BH_3$

Compounds of the General Formula (III)

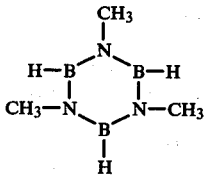

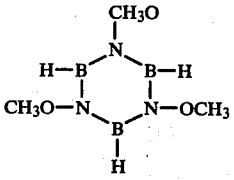

Compounds of the General Formula (IV)

$(CH_3)_4N^+(B_2H_8)^-$ $[(CH_3)_4N]_2{}^{+2}(B_2H_6)^{-2}$ $[(CH_3)_4N]_2{}^{+2}(B_5H_9)^{-2}$ $[(CH_3)_4N]_2{}^{+2}(B_{10}H_{14})^{-2}$ $(CH_3)_3C_{18}H_{37}N^+(B_3H_8)^{31}$ $(CH_3)_3S^+(B_3H_8)^-$

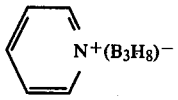

$(CH_3)_4P^+(B_3H_8)^-$ $Na_2{}^+B_5H_9{}^{-2}$ $Na_2^+(B_{10}H_{14})^{-2}$

Of the compounds described above, $NaBH_4$, $KBH_4$ and $(CH_3)_2NH\text{-}BH_3$ are particularly preferred.

The dyes used in this invention are reductively bleachable dyes and illustrative examples include azo dyes, anthraquinone dyes, etc. Typical examples of these dyes are described in *Color Index*, Vol. 4, 3rd Edition, The Society of Dyers and Colorists. Particularly suitable dyes which can be used in this invention are azo dyes such as monoazo dyes (C.I. 11,000–19,999); bisazo dyes (C.I. 20,000–29,999); trisazo dyes (C.I. 30,000–34,999); polyazo dyes (C.I. 35,000–36,999); triarylmethane dyes (C.I. 42,000–44,999); acridine dyes (C.I. 46,000–46,999); azine dyes (C.I. 50,000–50,999); thiazine dyes (C.I. 52,000–52,999); anthraquinone dyes (C.I. 58,000–72,999). (In the descriptions given herein "C.I." designates the Color Index number.)

Also, the dyes used in the silver-dye-bleach process can all be used in the process of this invention.

Yellow dyes usually used include azo dyes such as Direct Fast Yellow GC (C.I. 29,000), Sirius Supra Yellow R (C.I. 29,025), Chrysophenine (C.I. 24,895), etc.; benzoquinone dyes, anthraquinone dyes and polycyclic soluble vat dyeing dyes such as Indigosol Yellow HCGN (C.I. 56,006), Indigosol Golden Yellow IGK (C.I. 59,101), Indigosol Yellow 2 GB (C.I. 61,726), Algosol Yellow GCA-CF (C.I. 67,301), Indigosol Yellow V (C.I. 60,531), Indanthrene Yellow 4GF (C.I. 68,420), Indanthrene Yellow G (C.I. 70,600), Mikethren Yellow GC (C.I. 67,300), Indanthrene Yellow 4 GK (C.I. 68,405), etc. Also, magenta dyes generally used include azo dyes such as Nippon Fast Red BB (C.I. 29,100), Sirius Supra Rubbine B (C.I. 25,380), Sumilight Supra Rubinol B (C.I. 29,225), Benzo Brilliant Gelanine B (C.I. 15,080), etc.; soluble vat dyeing dyes selected from indigoid series, benzoquinone series and anthraquinone series heteropolycyclic compounds such as Indigosol Brilliant Pink IR (C.I. 73,361), Indigosol Red Violet IRH (C.I. 73,386), Indigosol Violet 15R (C.I. 59,321), Indigosol Red Violet IRRL (C.I. 59,316), Indigosol Red IFBB (C.I. 67,001), Indanthrene Red Violet RRK (C.I. 67,895), Mikethren Brilliant Violet BBK (C.I. 63,355), etc. Further, cyan dyes generally used include azo dyes such as Direct Sky Blue 6B (C.I. 24,410), Direct Blue 2B (C.I. 22,610), Direct Brilliant Blue RW (C.I. 24,280), Sumilight Supra Blue G (C.I. 34,200), etc.; phthalocyanine compounds such as Sumilight Supra Turkish Blue G (C.I. 74,180), Mikethren Brilliant Blue 4G (C.I. 74,140), etc., and also azo dyes and vat dyeing dyes such as Indanthrene Turkish Blue 3GK (C.I. 67,915), Indanthrene Blue 5G (C.I. 69,845), Indanthrene Blue GCD (C.I. 69,810), Indigosol 04B (C.I. 73,066), Indigosol 04G (C.I. 73,046), Anthrasol Green IB (C.I. 59,826), etc.

Furthermore, the dyes described in U.S. Pat. Nos. 2,286,714, 2,286,837, 2,294,892, 2,294,893, 2,418,624, 2,420,630, 2,420,631, 2,612,448, 2,629,658, 2,705,708, 2,694,636, 3,002,964, 3,114,634 and 3,119,811 can be used in this invention.

The dyes incorporated in the photographic elements used in the process of this invention are bleachable dyes and, a wide variety of dyes which are appropriate to the purpose of this invention can be used. The term "bleachable dye" as used in the description given herein includes dye precursors, that is, compounds which color during the development or during other processing steps of the photographic elements containing such precursors. The dyes used in this invention also include bleachable dyes which are diffusible but become non-diffusible upon dyeing a binder such as gelatin, bleachable dyes which are diffusible but become non-diffusible by using a suitable mordant, such as described in U.S. Pat. No. 2,882,156, and bleachable dyes which are non-diffusible in a silver halide emulsion.

The photographic element used in this invention may have a single silver halide emulsion layer or coating for obtaining a monochromatic dye image, which may be colored or neutral gray, formed by a single dye or a mixture of dyes. Typical useful neutral dyes for such a photographic material are the azo dyes as described in British Pat. No. 999,996.

Also, the photographic element used in this invention may have a plurality of layers and contain a plurality of different bleachable dyes for forming natural or multicolor images. A particularly useful photographic element which can be employed in this invention has at least three silver halide emulsion layers which respectively contain a non-diffusible yellow dye, a non-diffusible magenta dye and a non-diffusible cyan dye and which have been sensitized, respectively, to blue light, green light and red light.

The silver halide emulsion layer used in this invention contains a bleachable dye. However, if desired, the bleachable dye can be incorporated in an alkali-permeable layer adjacent the silver halide emulsion layer and this approach is sometimes preferred. With such a configuration, the speed of the color photographic material can be increased when the dye-containing layer is disposed under the silver halide emulsion layer. An example of such a configuration is a multilayer color photographic element having formed, in succession, on a support the following layers: a blue-sensitive silver halide-containing layer, a bleachable yellow dye-containing layer, a green-sensitive silver halide-containing layer, a bleachable magenta dye-containing layer, a red-sensitive silver halide-containing layer, and a bleachable cyan dye-containing layer.

In one embodiment of this invention, the dyes may be incorporated in a processing bath in an amount of about 1 to 200 g/l, preferably 1 to 100 g/l, and the dyes used for the purpose are water-soluble and diffusible dyes. In this case, the binder in a photographic element is dyed by the diffusible dye and the dye thus becomes non-diffusible. Also, by using an appropriate mordant in the photographic element, the dye diffused can be rendered non-diffusible.

Appropriate mordants which can be used for this purpose are the polymers described in British Pat. No. 685,475, U.S. Pat. Nos. 2,675,316, 2,839,401, 2,882,156, 3,048,487, 3,184,309 and 3,445,231, West German patent application (OLS) No. 1,914,362 and Japanese Patent applications (OPI) Nos. 47,624/75 and 71,322/75 (The term "OPI" as used herein refers to a "published unexamined Japanese patent application").

The photographic material used in this invention contains a silver salt. Suitable silver salts are silver halides such as silver chloride, silver bromide, silver iodide, silver chlorobromide, silver iodobromide, and silver chloroiodobromide and silver salts of organic acids such as silver behenate. The metallic silver used in this invention is fine granular metallic silver and a typical example of a fine granular metallic silver is colloidal silver.

Furthermore, photographic materials of a non-silver salt type such as zinc oxide photographic materials may be also used as the photographic materials employed in this invention. In this case, an imagewise distribution of silver is obtained by physically developing the photographic material using a silver salt after imagewise exposure. Moreover, the silver nuclei may be formed by utilizing physical development as described in Dutch Pat. No. 6,603,640, German Pat. No. 1,216,685 and U.S. Pat. No. 3,157,502.

The dye bleach bath used in this invention preferably contains an aromatic compound having a polarographic half-wave potential of about −1.8V to about −0.4V (against a saturated calomel electrode) as a dye bleach accelerator.

Preferred dye bleach accelerators are illustrated as follows: pyridine, pyrazine, naphthazine, quinoline or derivatives thereof; compounds (for example, quinoxalines, phenazines, anthraquinones, naphthoquinones) represented by the following general formulae as described in U.S. Pat. No. 2,270,118:

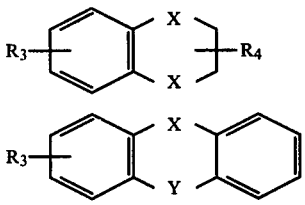

wherein X and Y each represents

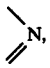

>S,>O,>C=O or >C=N—$R_5$, $R_5$ represents an alkyl group having 1 to 4 carbon atoms; and $R_3$ and $R_4$ each represents —$NH_2$, —OH, an alkyl group, a phenyl group or —$SO_3Na$; N-substituted isoaroxazines represented by the following general formula as described in U.S. Pat. No. 2,541,884:

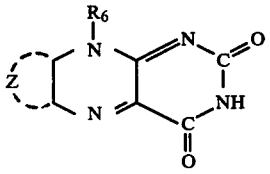

wherein $R_6$ represents an aliphatic group, an aryl group or an aralkyl group; and Z represents an aromatic group or a heterocyclic group; indophenazines represented by the following general formulae as described in U.S. Pat. No. 2,627,461:

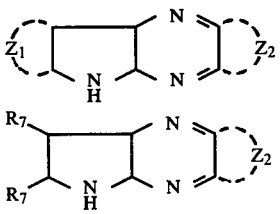

wherein $R_7$ represents a monocyclic aromatic group; and $Z_1$ and $Z_2$ each represents an aromatic group; furoquinoxalines or thienoxalines represented by the following general formula as described in U.S. Pat. No. 2,669,517:

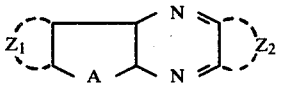

wherein A represents an oxygen atom or a sulfur atom; and $Z_1$ and $Z_2$ each represents an aromatic ring; lumazines or aroxazines represented by the following general formulae as described in British Pat. No. 657,374:

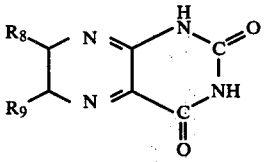

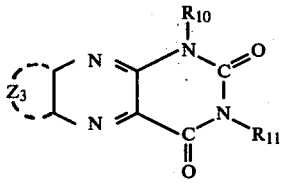

wherein $R_8$ and $R_9$ each represents a hydrogen atom, an alkyl group or an aryl group; one of $R_{10}$ and $R_{11}$ represents a hydrogen atom and the other of $R_{10}$ and $R_{11}$ represents a methyl group; and $Z_3$ represents an aromatic ring or a heterocyclic ring.

Examples of particularly preferred specific compounds which can be used as dye bleach accelerators are illustrated below.

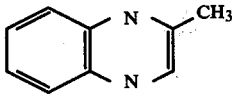

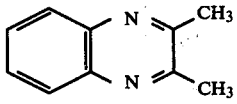

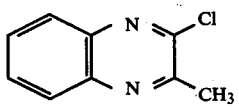

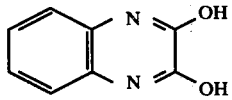

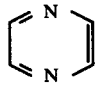

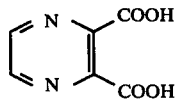

-continued

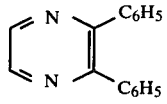

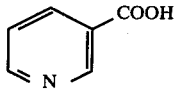

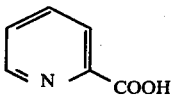

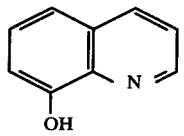

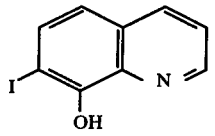

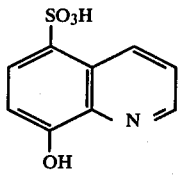

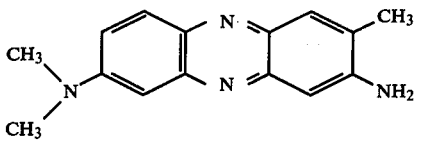

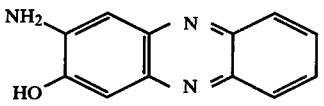

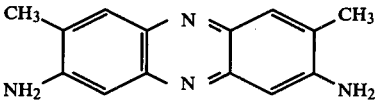

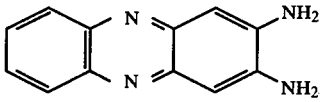

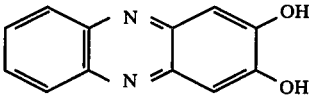

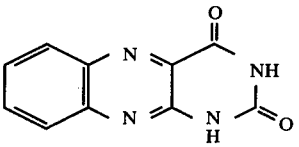

-continued

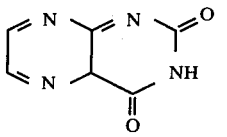

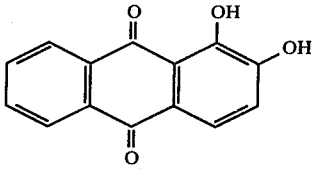

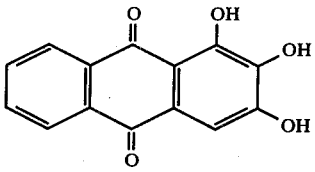

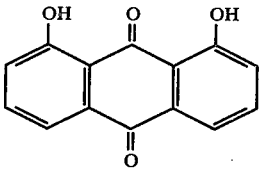

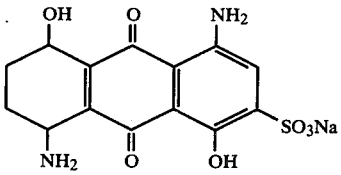

The dye bleach bath used in the process of this invention is preferably an aqueous solution, although a water-miscible organic solvent (for example, methanol, ethanol, acetone, etc.) can be added to the dye bleach bath, if desired. The dye bleach bath composition contains at least one boron hydride compound and, more preferably, contains at least one dye bleach accelerator. Moreover, if desired, the dye bleach bath composition may also contain a pH buffering agent such as a phosphate, a carbonate, etc.; a salt such as a sulfate, a perchlorate, a nitrate, etc.; an alkali such as sodium hydroxide, ammonium hydroxide, etc.; and an acid such as sulfuric acid, nitric acid, phosphoric acid, acetic acid and citric acid.

The amount of the boron hydride compound in the dye bleach bath is about $1 \times 10^{-3}$ to about 2 mols/liter, preferably $5 \times 10^{-3}$ to 1 mol/liter. Also, the amount of the dye bleach accelerator in the dye bleach bath is about $1 \times 10^{-4}$ to about 1 mol/liter, preferably $5 \times 10^{-4}$ to $5 \times 10^{-1}$ mol/liter, more preferably $1 \times 10^{-3}$ to $1 \times 10^{-1}$ mol/liter. Further, the pH of the dye bleach bath is about 9 to about 14, preferably 10 to 12.5.

The developer used for forming an image pattern of developed silver in a photographic element containing silver halide is a developer containing at least one developing agent such as an aminophenol (for example, 4-(N-methylamino)phenol, N,N-diethyl-p-aminophenol, etc.); a 3-pyrazolidone (e.g., 1-phenyl-3-pyrazolidone, 4,4-dimethyl-1-phenyl-3-pyrazolidone, 4-methyl-4-hydroxymethyl-1-phenyl-3-pyrazolidone, 4,4-dihydroxymethyl-1-phenyl-3-pyrazolidone, etc.); a dihydroxybenzene (e.g., hydroquinone, methylhydroquinone, chlorohydroquinone, catechol, 4-phenylcatechol, etc.); and ascorbic acid.

The developer may further contain, if desired, the following additives.

For example, alkali agents and buffering agents such as sodium hydroxide, potassium hydroxide, sodium carbonate, potassium carbonate, sodium tertiary phosphate, potassium tertiary phosphate, potassium metaborate, and borax can be used individually or as a combination thereof. Also, for the purposes of imparting a buffering capability to the developer improving the ability of the developer to act as a solvent, and further for increasing the ionic strength of the developer, various salts such as disodium hydrogenphosphate, dipotassium hydrogenphosphate, potassium dihydrogenphosphate, sodium dihydrogenphosphate, sodium hydrogencarbonate, potassium hydrogencarbonate, boric acid, an alkali metal nitrate, an alkali metal sulfate, etc., may be used in the developer.

Furthermore, if desired, the developer used in this invention may contain a development accelerator. Examples of useful development accelerators are the various pyridinium compounds and other cationic compounds as described in U.S. Pat. Nos. 2,648,604 and 3,671,247 and Japanese Patent Publication No. 9503/69; cationic dyes such as phenosafranine; neutral salts such as thallium nitrate and potassium nitrate; polyethylene glycol and the derivatives thereof as described in Japanese Patent Publication No. 9504/69 and U.S. Pat. Nos. 2,533,990, 2,531,832, 2,950,970 and 2,577,127; nonionic compounds such as polythioethers; the organic solvents and organic amines as described in Japanese Patent Publication No. 9509/69 and Belgian Pat. No. 682,862; ethanolamine; ethylenediamine; diethanolamine; and also the development accelerators as described in L. F. A. Mason, *Photographic Processing Chemistry,* pp. 40–43, Focal Press, London (1966).

Other examples of useful development accelerators which can be employed in this invention are benzyl alcohol and phenylethyl alcohol as described in U.S. Pat. No. 2,515,147, and pyridine, ammonia, hydrazine and the amines as described in *Journal of the Society of Photographic Science and Technology of Japan,* Vol. 14, p. 74 (1952).

Moreover, sodium sulfite, potassium sulfite, potassium hydrogensulfite, sodium hydrogensulfite, etc., which are usually used as preservatives may be employed in the developer used in this invention.

Also, the developer used in this invention may further contain, if desired, an antifoggant. Examples of anti-foggants include an alkali metal nalide such as potassium bromide, sodium bromide, potassium iodide, etc., as well as organic antifoggants. Examples of organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as thiosalicylic acid, etc. The amount of the antifoggant generally used is about 1 mg to about 5 g, preferably 5 mg to 1 g, per liter of the developer.

Still further, polyphosphoric acid compounds such as sodium hexametaphosphate, sodium tetrapolyphosphate, sodium tripolyphosphate, potassium hexametaphosphate, potassium tetrapolyphosphate, potassium tripolyphosphate, etc.; and aminopolycarboxylic acids such as phosphonocarboxylic acids, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., may be also used as a water softener in the developer. The amount of the water softener depends upon the hardness of water used but is usually about 0.5 to about 1 g/l.

Furthermore, a calcium or magnesium sequestering agent may be used in the photographic processing solution as described in detail in J. Willems, *Belgische Chemische Industrie,* Vol. 21, 325 (1956) and ibid., Vol. 23, 1105 (1958).

By adding a silver halide solvent, the developer can be used as a monobath developer-fixer solution. Fixing agents well known in the art can be used as the silver halide solvent. Specific examples of suitable fixing agents are thiosulfates such as sodium thiosulfate, potassium thiosulfate, etc.; thiocyanates such as potassium thiocyanate, sodium thiocyanate, etc.; organic amines such as alkanolamine, etc.; and thioether compounds. A monobath developer-fixer solution is described in, for example, L. F. A. Mason, *Photographic Processing Chemistry,* pp. 156–160, Focal Press, London (1966).

The color photographic element used in the first embodiment of this invention in the process of this invention basically comprises a support having at least one silver halide emulsion layer thereon but usually the color photographic element used in this invention comprises a support having thereon a red-sensitive silver halide emulsion layer, a green-sensitive silver halide emulsion layer, and a blue-sensitive silver halide emulsion layer. Most generally, the color photographic element used in the invention comprises a support having thereon at least one red-sensitive silver halide emulsion layer containing a cyan dye, at least one green-sensitive silver halide emulsion layer containing a magenta dye, and at least one blue-sensitive silver halide emulsion layer containing a yellow dye. Such a color photographic element may further contain non-photosensitive photographic layers (for example, an antihalation layer, an interlayer for preventing color mixing, a yellow filter layer, a protective layer, etc.). Also, the order of positioning on the support of the red-sensitive layer, the green-sensitive layer and the blue-sensitive layer is not particularly limited. Each dye may be present in a layer containing silver halide or may be present in a photographic layer adjacent a silver halide emulsion layer.

The color photographic element processed in the process of this invention may contain silver bromide, silver chloride, silver chlorobromide, silver iodobromide or silver iodochlorobromide as the silver halide in the photographic emulsion layer or layers. When the color photographic element has two or more photographic emulsion layers, a combination of two or more of the silver halides described above may be employed.

The silver halide photographic emulsion may be prepared using the processes described in P. Grafkides, *Chimie Photographique,* Paul Montel, Paris (1957) and further the silver halide emulsion may also be prepared using any one of an ammonia method, a neutral method, an acid method, a single jet method, a reverse mixing method, a double jet method, and a controlled double jet method.

The crystal form of the silver halide grains may be that of a cubic system, an octahedral system, or a mixed crystal system thereof. The silver halide grains used in this invention may be the type having a uniform crystal structure throughout the grain, may be the type having a layered structure where the surface of the grain is different from the interior of the grain, or may be the so-called conversion type as described in British Pat. No. 633,841 and U.S. Pat. No. 3,622,318. Furthermore, the silver halide grains used in this invention may be the type forming a latent image mainly on the surface of the grain or may be the type forming a latent image in the interior of the grain.

The silver halide emulsion used in this invention may be chemically sensitized using known methods. For chemical sensitization, the sulfur compounds as described in U.S. Pat. No. 1,574,944, the gold compounds as described in U.S. Pat. No. 2,399,083, the compound of noble metals such as platinum, palladium, iridium, rhodium, ruthenium, etc., as described in U.S. Pat. Nos. 2,448,060 and 2,598,079 and British Pat. No. 618,061, and reducing agents such as stannous salts and amines may be used.

In the silver halide emulsion layers and other photographic layers of the photographic light-sensitive materials processed by the process of this invention, gelatin is usually used as the hydrophilic colloid but hydrophilic colloids other than gelatin may be used. For example, gelatin derivatives; graft polymers of gelatin with other polymers; cellulose derivatives such as hydroxyethyl cellulose, carboxymethyl cellulose, cellulose sulfate, etc.; saccharide derivatives such as sodium alginate, starch derivatives, etc.; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc., can be used.

In addition, lime treated gelatin, acid treaded gelatin, a hydrolyzed product of gelatin, and an enzyme treated gelatin can be used as the gelatin.

Gelatin derivatives which can be used are those which are obtained by reacting gelatin with various kinds of compounds, for example, an acid halide, an acid anhydride, an isocyanate, a bromoacetic acid, an alkanesultone, a vinylsulfonamide, a maleinimide compound, a polyalkylene oxide, and an epoxy compound. Specific examples of gelatin derivatives are described in U.S. Pat. Nos. 2,614,928, 3,132,945, 3,186,846 and 3,312,553, British Pat. Nos. 861,414, 1,033,189 and 1,005,784, Japanese Patent Publication No. 26845/1967, etc.

Gelatin graft polymers which can be used are those which are obtained by grafting a polymer or copolymer of a vinyl monomer such as acrylic acid, methacrylic acid, or an ester or an amide derivative thereof, acrylonitrile, styrene, etc., to gelatin. Particularly preferred polymers are those compatible with gelatin to some extent, e.g., polymers of acrylic acid, methacrylic acid, acrylamide, methacrylamide, and hydroxyalkyl methacrylates, etc. Examples of these compounds are described in U.S. Pat. Nos. 2,763,625, 2,831,767 and 2,956,884, etc.

Typical synthetic hydrophilic high molecular weight materials are described, for example, in German Patent Application (OLS) No. 2,312,708, U.S. Pat. Nos. 3,620,751 and 3,879,205, Japanese Patent Publication No. 7561/1968, etc.

The light-sensitive materials used in this invention may further contain the hardening agents as described in U.S. Pat. No. 3,325,287; plasticizers such as the compounds as described in U.S. Pat. No. 3,775,128, and glycerol; alkylbenzene sulfonates; alkylene oxide condensation products; the compounds as described in U.S. Pat. Nos. 2,739,891 and 3,415,649; other surface active agents; and other additives for improving the photographic properties, image characteristics, and physical properties of the light-sensitive materials.

The photographic element processed by the process of this invention may contain an ultraviolet absorbent in a hydrophilic colloid layer. Examples of such ultraviolet absorbents are aryl-substituted benzotriazole compounds as described in, for example, U.S. Pat. No. 3,533,794; 4-thiazolidone compounds as described in, for example, U.S. Pat. Nos. 3,314,794 and 3,352,681; benzophenone compounds as described in, for example, Japanese Patent Application (OPI) No. 2,784/71; cinnamic acid esters as described in U.S. Pat. Nos. 3,705,805 and 3,707,375; and benzoxazole compounds as described in, for example, U.S. Pat. No. 3,499,762.

Morever, the hydrophilic colloid layers of the light-sensitive materials processed by the process of this invention may further contain stilbene series fluorescent brightening agents, triazine series brightening agents, oxazole series brightening agents, or cumarin series brightening agents. They may be water-soluble or water-insoluble and in the latter case, they may be used as dispersions thereof. Suitable examples of these fluorescent brightening agents are described in U.S. Pat. No. 2,632,701, 3,269,840 and 3,359,102 and British Patent 1,319,763.

For obtaining a photographic image, the light-sensitive material is first imagewise exposed in an ordinary manner. That is, various light sources such as natural ight (sunlight), a tungsten lamp, a fluorescent lamp, a mercury lamp, a xenon arc lamp, a carbon arc lamp, a xenon flash lamp, a cathode ray tube flying spot, etc., may be employed for the exposure. The exposure time usually ranges from about 1/1,000 second to 1 second as generally used for camera exposure but a shorter exposure time, for example, about $1/10^4$ to about $1/10^6$ second using a xenon flash lamp or a cathode ray tube flying spot and also an exposure longer than 1 second can be employed in this invention. If desired, the spectral composition of the light used for exposure can be controlled by a color filter. Furthermore, laser light may be used for the exposure. Moreover, the exposure may be performed using the light emitted from a phosphor excited by an electron beam, X-rays, gamma rays, alpha rays, etc.

The process of this invention is superior to conventional processes. Some of the advantages of the process of this invention are set forth below.

(1) Color images having excellent light fastness, heat resistance, and moisture resistance as compared with those obtained by conventional color development processing are obtained.

(2) The amount of silver or silver salt in the color photographic materials can be greatly reduced as compared with that required for conventional color development processing, the silver dye bleach method, and the color intensification method.

(3) Since the amount of silver or silver salt and the amount of polymers such as gelatin in the color photographic materials can be reduced, the thickness of the emulsion layers can be reduced effectively, which results in increasing the sharpness of the images obtained.

(4) Chemicals such as p-phenylenediamine derivatives which are hazardous, usually used in conventional color development processing, and a strongly acidic processing solution having a strong corrosive activity, usually used in a conventional silver dye bleach process, do not need to be used in this invention.

(5) As compared with a color intensification process using a cobalt (III) complex and hydrogen peroxide, the process of this invention is simple in terms of the processing steps involved.

The invention is further described more specifically by reference to the following examples but the invention is not to be construed as being limited to the embodiments illustrated in these examples. Unless otherwise indicated herein, all parts, percents, ratios and the like are by weight.

EXAMPLE 1

A photographic element was prepared by coating on a cellulose triacetate support having a subbing layer thereon a silver iodobromide emulsion (silver iodide: 4 mol%; mean grain size: 0.7 micron) containing a cyan dye (coated amount of 806 mg/m$^2$) having the structure shown below:

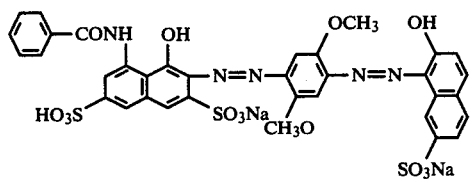

at a coated amount of silver of 50 mg/m$^2$ and then coating thereon a gelatin protective layer at a coated amount of gelatin of 1,000 mg/m$^2$.

The photographic element was exposed through an optical wedge using an actinometer to a tungsten lamp of a color temperature of 2,854° K. at a maximum of 1,000 CMS and then processed in one of the following two Processes A and B.

Process A (process of this invention)

| Processing | Temperature (°C.) | |
|---|---|---|
| Development | 25 | 4 min |
| Fix | " | 2 min |
| Wash | " | 2 min |
| Dye Bleach | 40 | 8 – 16 min |
| Wash | 25 | 1 min |
| Blix | " | 3 min |
| Wash | " | 2 min |

The compositions of the processing solutions used in the above processing were as follows:

| | |
|---|---|
| **Developer** | |
| Disodium Ethylenediaminetetraacetate | 1 g |
| Sodium Sulfite | 60 g |
| Hydroquinone | 10 g |
| Sodium Hydroxide | 5 g |
| Diethylene Glycol | 20 ml |
| 1-Phenyl-3-pyrazolidone | 0.4 g |
| Sodium Carbonate | 20 g |
| Potassium Bromide | 9 g |
| Benzotriazole | 0.1 g |
| Water to make | 1 l |
| **Fixing Solution** | |
| Sodium Thiosulfate ($5H_2O$) | 240 g |
| Sodium Sulfite | 15 g |
| Glacial Acetic Acid | 13.3 g |

-continued

| | |
|---|---|
| Boric Acid | 7.5 g |
| Potassium Alum | 15 g |
| Water to make | 1 l |
| **Dye Bleach Solution** | |
| Sodium Carbonate (anhydrous) | 10.8 g |
| Sodium Borohydride | 1.89 g |
| Water to make | 1 l |
| | (pH 11.0) |
| **Blix Solution** | |
| Ammonium Thiosulfate | 150 ml |
| Sodium Sulfite | 5 g |
| Sodium [Iron (III)-ethylenediamine-tetraacetic acid complex salt] | 40 g |
| Disodium Ethylenediaminetetraacetate | 4 g |
| Water to make | 1 l |

Process B (silver dye bleach process for comparison)

| Processing | Temperature (°C.) | Time |
|---|---|---|
| Development | 25 | 4 min |
| Wash | " | 2 min |
| Dye Bleach | 40 | 7 – 13 min |
| Wash | 25 | 1 min |
| Blix | " | 3 min |
| Wash | " | 3 min |

The compositions of the processing solutions used were as follows:

| | |
|---|---|
| **Developer** | |
| Same as the developer composition of Process A. | |
| **Dye Bleach Solution** | |
| Hydrochloric Acid (35%) | 100 ml |
| Phenazine | 18 mg |
| Thiourea | 100 g |
| Water to make | 1 l |
| **Blix Solution** | |
| Same as blix solution composition of Process A. | |

The results obtained are shown in Table 1 below.

Table 1

| Process | Dye Bleaching Time (min) | Maximum Cyan Density | Minimum Cyan Density | Gamma Value | Sensitivity* |
|---|---|---|---|---|---|
| Process A (invention) | 8 | 2.02 | 0.08 | 2.1 | 1.0 |
| | 12 | 2.01 | 0.06 | 2.3 | 1.3 |
| | 16 | 2.02 | 0.05 | 2.7 | 1.5 |
| Process B (comparison) | 7 | 2.00 | 1.56 | 0.24 | — |
| | 10 | 2.01 | 1.55 | 0.25 | — |
| | 13 | 2.00 | 1.55 | 0.25 | — |

*Relative sensitivity when the sensitivity of the photographic element processed for 8 minutes in Process A was designated as 1.00. In Process B, the sensitivity value could not be determined since the minimum density was too high.

The conventional silver dye bleach process (Process B) required one equivalent of silver for bleaching the dye and, hence, when the process was applied to a low-silver light-sensitive material (mole ratio of silver to dye: 1:2) used in this example, insufficient bleaching resulted. On the other hand, in Process A of this invention, the silver acted catalytically and, hence, the bleaching was performed sufficiently and cyan positive images having a low minimum density were obtained. Also, by prolonging the time for the dye bleaching in the process of this invention, the sensitivity could be increased.

EXAMPLE 2

A photographic element was prepared using the same procedure as described in Example 1 except that a magenta dye (coated amount of 854 mg/m$^2$) having the structure shown below:

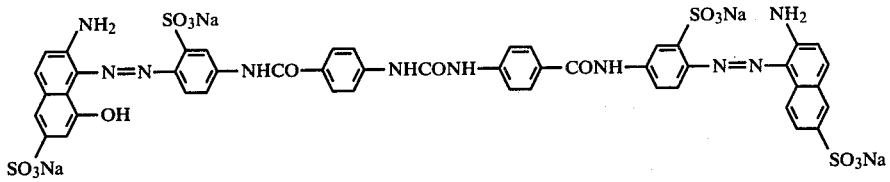

was used in place of the cyan dye and except that the coated amount of silver was 100 mg/m$^2$. The photographic element was exposed under the same conditions as in Example 1 and processed using Process A as described in Example 1 except that the following dye bleach solution was used in place of the dye bleach solution described in Example 1.

| Dye Bleach Solution | |
|---|---|
| Sodium Carbonate | 10.8 g |
| Sodium Borohydride | 1.89 g |
| Dimethylquinoxaline | 0.20 g |
| Water to make | 1 l |
| | (pH 11.0) |

Using a dye bleach processing time of 16 minutes, magenta positive images having a maximum magenta density of 2.50, a minimum magenta density of 0.05 and a gamma value of 2.21 were obtained.

EXAMPLE 3

A photosensitive element was prepared using the same procedure as described in Example 1 except that a yellow dye (coated amount of 1,580 mg/m$^2$) having the structure shown below:

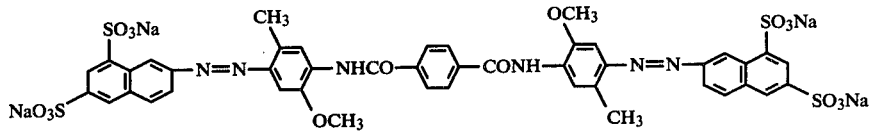

was used in place of the cyan dye and except that the coated amount of silver was 100 mg/m$^2$. The photographic element was exposed through an optical wedge using an actinometer to light from a tungsten lamp of a color temperature of 2,854° K. at a maximum of 10,000 CMS and then processed using Process A as described in Example 1.

Using a dye bleach processing time of 10 minutes, yellow positive images having a maximum yellow density of 2.02, a minimum yellow density of 0.03 and a gamma value of 1.8 were obtained.

EXAMPLE 4

A photographic element was prepared as described in Example 1, was exposed under the same conditions as in Example 1, and was processed using processing solutions having the same compositions as described in Process A of Example 1 except that the pH of the dye bleach solution was changed in the range of from 9.5 to 13.0. The results obtained are shown in Table 2 below.

Table 2

| pH of Dye Bleach Solution | Maximum Cyan Density | Minimum Cyan Density | Gamma Value |
|---|---|---|---|
| 9.5 | 2.07 | 0.60 | 1.20 |
| 10.0 | 2.10 | 0.15 | 1.40 |
| 11.0 | 2.07 | 0.02 | 2.22 |
| 12.0 | 2.05 | 0.02 | 1.60 |
| 12.5 | 2.06 | 0.12 | 1.42 |
| 13.0 | 2.06 | 1.02 | 0.80 |

The dye bleach processing was performed for 12 minutes.

The results show that the optimum pH value in the process of Example 1 is about 10 to 12.5.

EXAMPLE 5

A photographic element (silver coverage: 50 mg/m$^2$) was prepared by coating a silver chlorobromide emulsion (silver bromide: 70 mol%; mean grain size: 0.2 micron) containing a cyan dye (806 mg/m$^2$) having the same structure as in Example 1 in the same manner as described in Example 1.

The photographic element was exposed under the same conditions as in Example 1 and processed using Process A as described in Example 1.

Using a dye bleach processing time of 8 minutes, color images having a maximum cyan density of 0.84, a minimum cyan density of 0.01 and a gamma value of 1.01 were obtained.

EXAMPLE 6

A photographic element (silver coverage: 200 mg/m$^2$) was prepared by coating a silver iodobromide emulsion (silver iodide: 4 mol%; mean grain size: 0.7 micron) containing a cyan dye (806 mg/m$^2$) having the same structure as in Example 1 in the same manner as described in Example 1. The photographic element was exposed under the same conditions as in Example 1 and processed as follows:

| Processing step | Temperature (°C.) | Time |
|---|---|---|
| Development | 25 | 4 min |
| Wash | " | 2 min |
| Dye Bleach | 50 | 10 min |
| Wash | 25 | 1 min |
| Blix | " | 3 min |
| Wash | " | 2 min |

The compositions of the processing solutions used in the above processing were as follows:

| Developer (monobath development-fix solution) | |
|---|---|
| 1-Phenyl-3-pyrazolidone | 1.0 g |
| Sodium Sulfite | 30 g |
| Hydroquinone | 10 g |
| Sodium Carbonate (anhydrous) | 20 g |
| Sodium Hydroxide | 5 g |
| Sodium Thiosulfate ($5H_2O$) | 60 g |
| Water to make | 1 l |
| **Dye Bleach Solution** | |
| Sodium Carbonate (anhydrous) | 10.8 g |
| Dimethyl Aminoborane | 17.6 g |
| Water to make | 1 l |
| | (pH 11.0) |
| **Blix Solution** | |
| Same as the blix solution in Process A as described in Example 1. | |

Cyan positive images having a maximum cyan density of 2.02, a minimum cyan density of 0.02 and a gamma value of 2.00 were obtained.

While the invention has been described in detail and with reference to specific embodiments thereof, it will be apparent to one skilled in the art that various changes and modifications can be made therein without departing from the spirit and scope thereof.

What is claimed is:

1. A process of forming color images which comprises processing a photographic light-sensitive element comprising a support having thereon a layer containing silver imagewise distributed therein with an aqueous alkaline solution containing a boron hydride compound and in the presence of a dye to bleach the dye in an imagewise manner.

2. The process of forming color images as claimed in claim 1, wherein the aqueous alkaline solution containing the boron hydride compound has a pH of about 10 to about 12.5.

3. The process of forming color images as claimed in claim 1, wherein the photographic light-sensitive element contains silver halide in an amount of from about 10 $mg/m^2$ to about 1.0 $g/m^2$ for each silver halide emulsion layer thereof.

4. The process of forming color images as claimed in claim 1, wherein the dye is incorporated into the photographic light-sensitive element and the dye is present in an amount of at least about 100% excess over the stoichiometrically required amount based on the silver salt.

5. The process of forming color images as claimed in claim 1, wherein the boron hydride compound is a compound represented by the following general formula (I), (II), (III) or (IV):

$$MBH_4 \quad \text{(I)}$$

wherein M represents an alkali metal ion or an ammonium ion;

$$M_1BH_3 \quad \text{(II)}$$

wherein $M_1$ represents ammonia, an amine, a hydrazine or a phosphine;

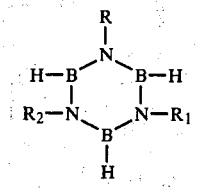

(III)

wherein R, $R_1$ and $R_2$, which may be the same or different, each represents a hydrogen atom, a halogen atom, an alkyl group or an alkoxy group;

$$(M_2^{+c})_x(B_yH_z)^{-xc} \quad \text{(IV)}$$

wherein $M_2$ represents a quaternary ammonium ion, a heterocyclic quaternary ammonium ion, a sulfonium ion, a quaternary phosphonium ion, an alkali metal ion or an alkaline earth metal ion; c, x and y each represents a positive integer; and z represents a positive integer of not less than 4.

6. The process of forming color images as claimed in claim 1, wherein the aqueous alkaline solution containing the boron hydride compound additionally contains an aromatic compound, as a dye bleach accelerator, having a polarographic half-wave potential of from about −1.8V to about −0.4V with respect to a saturated calomel electrode.

7. The process of forming color images as claimed in claim 1, wherein the boron hydride compound is $NaBH_4$, $KBH_4$ or $(CH_3)_2NHBH_3$.

8. The process of forming color images as claimed in claim 1, wherein the dye is an azo dye, a triarylmethane dye, an acridine dye, an azine dye, a thiazine dye or an anthraquinone dye, capable of being reductively bleached.

9. The process of forming color images as claimed in claim 1, wherein the amount of the boron hydride compound in the aqueous alkaline solution is from about $1 \times 10^{-3}$ to about 2 mols/liter.

10. The process of forming color images as claimed in claim 6, wherein an amount of the dye bleach accelerator in the aqueous alkaline solution is from about $1 \times 10^{-4}$ to about 1 mol/liter.

11. The process of forming color images as claimed in claim 1, wherein the silver images comprise chemically developed silver images.

12. The process of forming color images as claimed in claim 1, wherein the silver images comprise physically developed silver images or print-out silver images.

13. The process of forming color images as claimed in claim 1, wherein the silver images comprise latent silver images.

14. A process of forming color images which comprises processing an imagewise exposed and developed photographic element comprising a support having thereon a layer containing silver imagewise distributed therein and containing a dye with an aqueous alkaline solution containing a boron hydride compound to reductively bleach the dye at the areas where silver is present.

15. A process of forming color images which comprises developing an imagewise exposed photographic element comprising a support having thereon at least one layer containing a silver halide emulsion and containing a dye to form an image pattern of developed silver and then processing the photographic element in an aqueous alkaline solution containing a boron hydride compound to bleach the dye at the areas containing the silver image pattern.

16. A process of forming color images comprising imagewise exposing a photographic element comprising a support having at least one silver halide emulsion layer thereon, developing said imagewise exposed photographic element, immersing the developed photographic element in a dye-containing bath to dye the photographic element with the dye in the bath, and then immersing the photographic element in an alkaline aqueous solution containing a boron hydride compound to bleach the dye in an imagewise manner.

17. A process of forming color images comprising imagewise exposing a light-sensitive photographic material comprising a support having thereon a silver halide emulsion layer containing a halogen acceptor and a dye or comprising a support having thereon a layer containing a silver salt capable of being easily thermally decomposed and a dye, and then immersing the imagewise exposed photographic material in an aqueous alkaline solution containing a boron hydride compound, whereby the dye is bleached at the areas containing the print-out silver image to provide a color positive image.

18. A process of forming color images comprising heat developing an imagewise exposed photographic element comprising a support having in one or more layers thereon an organic silver salt, a light sensitive silver halide, a reducing agent for the organic silver salt and a dye and then immersing the photographic element in an aqueous alkaline solution containing a boron hydride compound to bleach the dye in an imagewise manner.

* * * * *